US007395747B2

(12) United States Patent
Murello

(10) Patent No.: US 7,395,747 B2
(45) Date of Patent: Jul. 8, 2008

(54) BREECHBLOCK STOPS FOR FIREARMS AND METHODS OF OPERATING THE SAME

(75) Inventor: Johannes Murello, Deisslingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/432,945

(22) Filed: May 12, 2006

(65) Prior Publication Data

US 2008/0078284 A1 Apr. 3, 2008

Related U.S. Application Data

(63) Continuation of application No. PCT/EP04/12727, filed on Nov. 10, 2004.

(30) Foreign Application Priority Data

Nov. 14, 2003 (DE) ..... 103 53 155

(51) Int. Cl.
*F41A 17/28* (2006.01)

(52) U.S. Cl. ..... 89/137; 42/70.01; 42/70.05

(58) Field of Classification Search ..... 89/137; 42/70.01, 70.02, 70.04, 70.05
See application file for complete search history.

(56) References Cited

U.S. PATENT DOCUMENTS

| | | | | |
|---|---|---|---|---|
| 1,349,345 A | | 8/1920 | Payne | |
| 1,842,581 A | * | 1/1932 | Browning | 42/21 |
| 2,505,760 A | * | 5/1950 | Garand | 42/70.04 |
| 2,638,694 A | * | 5/1953 | Morris | 42/24 |
| 3,415,000 A | * | 12/1968 | Josef et al. | 42/70.02 |
| 4,057,003 A | | 11/1977 | Atchisson | |

(Continued)

FOREIGN PATENT DOCUMENTS

DE 1890933 U * 4/1964

(Continued)

OTHER PUBLICATIONS

International Bureau, International Preliminary Report on Patentability for PCT/EP2004/012727, Aug. 3, 2006, 6 pages.

(Continued)

*Primary Examiner*—Michael J. Carone
*Assistant Examiner*—Stewart T Knox
(74) *Attorney, Agent, or Firm*—Hanley, Flight & Zimmerman, LLC

(57) ABSTRACT

Firearms, breechblock stops for firearms and methods of operating the same are disclosed. An example firearm includes a trigger that requires a force to be released, a trigger guard, a breechblock, and a spring-loaded breechblock stop that is operable between a resting position and an operative position. The example breechblock stop includes a slider control that has a control extension in the trigger guard. The firearm also includes a removable ammunition magazine that includes a follower. The breechblock stop may be moved between an operative position and a resting position by one of engagement with the follower of the magazine or actuation of the slider in a direction of operation essentially perpendicular to force releasing the trigger. Furthermore, the breechblock is unlocked in a released position when the breechblock stop is in the resting position, and the breechblock is locked in an open position when the breechblock stop is in the operative position.

13 Claims, 3 Drawing Sheets

Resting Position

U.S. PATENT DOCUMENTS

| | | | | |
|---|---|---|---|---|
| 4,128,042 | A | 12/1978 | Atchisson | |
| 4,594,935 | A | 6/1986 | Smith | |
| 6,415,539 | B1 * | 7/2002 | Fuchs et al. | 42/70.07 |

FOREIGN PATENT DOCUMENTS

| | | |
|---|---|---|
| DE | 196 55 169 | 1/2003 |
| DE | 103 53 155.6 | 11/2003 |
| GB | 613 281 | 11/1948 |
| GB | 2 137 322 | 10/1984 |

OTHER PUBLICATIONS

International Search Report for PCT/EP2004/012727, Apr. 21, 2004, 2 pages.

English Translation of Written Opinion for International Patent Application Serial No. PCT/EP2004/012727, 2 pages.

International Bureau, International Preliminary Report on Patentability for PCT/EP2004/012727, May 15, 2006, 6 pages.

* cited by examiner

Operative Position

Resting Position

BREECHBLOCK STOPS FOR FIREARMS AND METHODS OF OPERATING THE SAME

RELATED APPLICATION

This patent is a continuation of International Patent Application Serial No. PCT/EP2004/012727, filed Nov. 10, 2004, which is hereby incorporated herein by reference in its entirety.

FIELD OF DISCLOSURE

This disclosure relates generally to firearms, and, more particularly, to breechblock stops for firearms and methods of operating the same.

BACKGROUND

Breechloading firearms include a breechblock that is a movable component of a firearm, which closes a breech at the moment of firing. When the breech is open, a spent shell may be expelled and a new cartridge loaded into the breech. Breechblock stops are used to prevent movement of the breechblock from the opened position to the closed position. A traditional breechblock stop is disclosed in German Patent DE 196 55 169.

One functional principle of a traditional breechblock stop, in particular a breechblock stop for automatic weapons, is that a tongue of the breechblock stop extends into a region of a follower of an ammunition magazine. In the case of an emptied magazine, the follower moves the tongue up and pushes a catching surface of the breechblock stop into the path of motion of the breechblock, which stops the breechblock behind the magazine. Frictional force applied by a lock spring between the breechblock and the catching surface is sufficient to keep the breechblock stop in engagement with the breechblock even without engagement of the follower such as, for example, if the magazine has been removed. The breechblock stop is unlocked by pulling back the breechblock together with a firing lever. Then a spring moves the breechblock stop downward so that the catching surface no longer lies in the path of motion of the breechblock, and the breechblock with the firing lever can move forward very rapidly while guiding a cartridge from the magazine into the cartridge chamber—provided the magazine is not empty. Thus, after replacement of an emptied magazine for a full one, the firing lever must be operated to reset the breechblock to make the weapon ready to fire again. This type of operation costs time, usually requires that the weapon must be brought out of an aiming position, and may cause the marksman to have to move out of his cover.

German Patent DE 18 90 933 U discloses another traditional breechblock stop that has an operative control next to a trigger guard that can be operated with one finger of the shooting hand to adjust the breechblock stop from the operative position to the resting position, which in turn would release the breechblock. This breechblock stop is designed as a swiveling lever whose operative control is operated in the same direction as the trigger but in opposing orientation. With this design, an involuntary extension of the trigger finger can result in the unlocking of the breechblock stop. In such arrangement, the operative control connected to the swiveling lever runs laterally outside of the trigger guard and can thus easily and/or unintentionally be operated or damaged by outside influences (e.g. by brushing up against objects, roots, equipment or the like).

DETAILED DESCRIPTION

The present examples illustrate a trigger device for a firearm, in particular a rifle that includes a spring-loaded breechblock stop, which can be moved by engagement with a follower of an ammunition magazine from a resting position, in which a breechblock is released, into an operative position, in which the breechblock stop locks the breechblock in open position. In one example, the breechblock stop includes an operative control arranged on a trigger guard that can be operated by a finger of the shooting hand that grasps a grip or handle. The operative control may also be actuated to adjust the breechblock stop from the operative position to the resting position so that the breechblock is released. The operative control of the breechblock stop is constructed as a slider including a control extension in the trigger guard. The direction of operation of the slider runs essentially perpendicular to the force releasing a trigger.

Throughout this description, positional terms such as "front", "up", "rear," etc. refer to a properly positioned weapon when firing in the normal firing position, i.e., horizontally such that the axis of the bore of the barrel runs horizontally forward in the direction of fire. Also all terms, such as "left" and "right" are specified from the point of view of the marksman.

Figure 1:
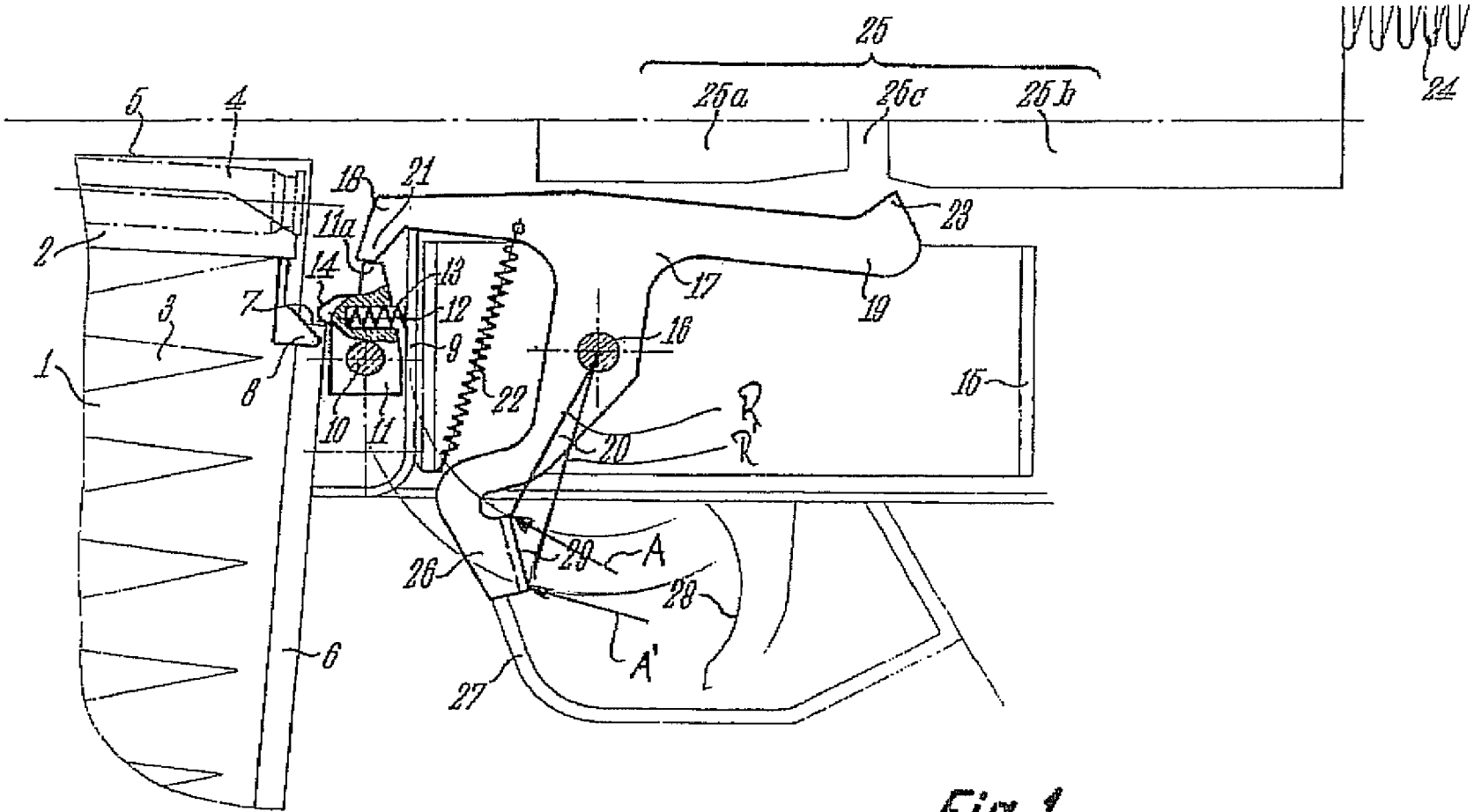
FIG. 1 shows a perspective view of a portion of an example case of a trigger portion of an example weapon with a portion of the case removed to expose an example breechblock stop.

FIG. 1 shows a portion of a weapon 1 at a trigger region 3. The weapon 1 includes a case 5, which itself includes a handle 7 and a magazine well 9. The weapon 1 also includes a removable magazine 11. At the upper end of the handle 7 there is a trigger guard 13 that extends from the trigger region 3 to a case region 15 and abuts the magazine well 9. As the trigger guard 13 extends toward the case region 15, the profile of the trigger guard 13 widens into an enlargement 17 that includes a first recess 19. An operative control or slider 21 extends into the trigger region 13 from the case 5 at the case region 15 along the first recess 19 and is partially enclosed by the enlargement 17. The slider 21 sits in the trigger region 3 opposite a trigger 23. The function of the slider 21 is described in further detail below.

There is an operating end 25 of a lever 27 at the underside of the case region 15. The lever 27 locks the magazine 11 in a spring-loaded manner. The operating end 25 of the lever 27 includes a first operative control 29 and a second operative control 31. The lever 27 is swivel-mounted with a pin 33 penetrating the case 5 between the magazine well 9 and the trigger region 3.

Figure 2:
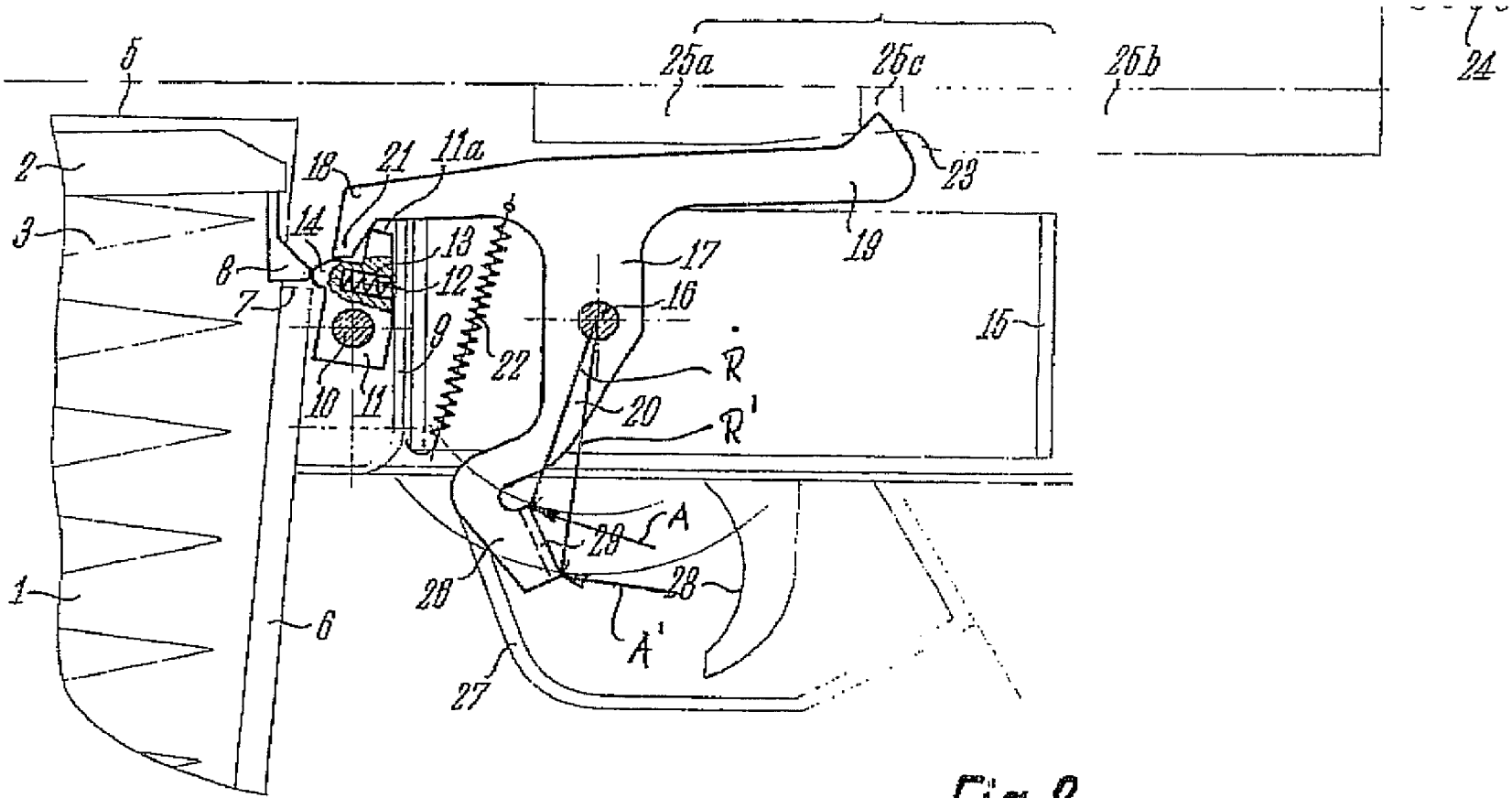
FIG. 2 shows a side view of the example case of FIG. 1 with a portion of the case remove to expose the interior of the case.
Figure 3:
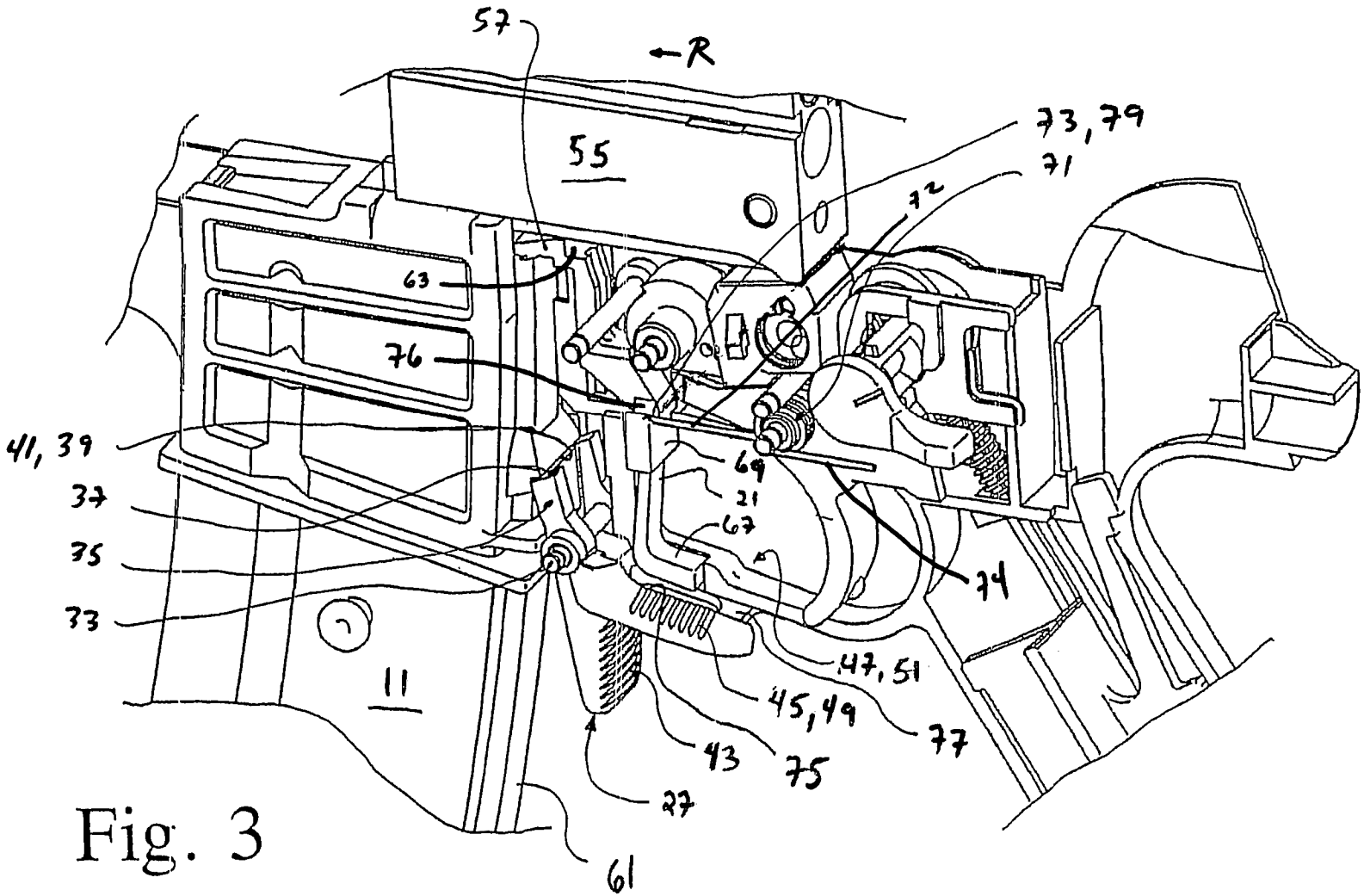
FIG. 3 shows an enlarged view of the interior of the case of FIG. 2.

FIGS. 2 and 3 show the lever 27 in greater detail. The lever 27 extends into the interior of the case region 15 and ends in a locking end 35. The locking end 35 supports a snap-in face 37 on the end pointing upward. In the locked position, the locking end 35 engages the magazine 11 at a magazine lip 39 to secure the magazine 11 into the magazine well 9. In addition, there may be a similarly designed but unmovable snap-in pair (not shown) on the opposite side of the magazine 11. The lever 27 itself is spring-loaded by a leg spring (not shown) in such a way that the locking end 35 engages the magazine lip 39 with the snap-in face 37.

As the magazine 11 is inserted into the magazine well 9, the upper side region of the magazine 11 glides along the locking end 35 and swivels the lever 27 against the spring-load until the lever 27 snaps into a groove 41 provided on the magazine lip 39. The magazine 11 is secured downward via the engagement of the magazine lip 39 with the snap-in face 37.

To release the magazine 11, the marksman uses one hand to grasp the end of the magazine 11 protruding out of the magazine well 9 so that the thumb of the marksman comes to rest on a first control surface 43 of the first operative control 29 facing the handle 7. While grasping the magazine 11, the thumb may exercise an unlocking force E on the first control surface 43, which swivels the lever 27 against the spring resistance so that the locking end 35 moves out of engagement with the magazine 11, i.e., the snap-in face 37 is no longer in engagement with the magazine lip 39 and the magazine 11 can be swiveled or pulled out of the magazine well 9.

Alternatively, the lever 27 can also be operated by the marksman's shooting hand that is grasping the handle 7. Through this manner, the force used to unlock the magazine 11 is exercised via the second operative control 31 by pressing (for example with the index finger or thumb) against the second operative control 31 via one of a second control surface 45 or a third control surface 47. The first operative control 29 and the second operative control 31 are variably oriented to receive differently directed unlocking forces to unlock the magazine 11. Though the third control surface is not fully shown in FIG. 3, the third control surface 47 is substantially the same as the second control surface 45 but located on the other side of the trigger guard 13. The second control surface 45 points obliquely upward on a first control flap 49 and, likewise, the third control surface 47 points obliquely upward on a second control flap 51. Thus, a downward force F may be applied to the second operative control 31 via the second control surface 45 of the first control flap 49 or the third control surface 47 of the second control flap 51, either or both of which would move the lever 27 from the locked position, which would release the magazine 11 from the locking end 35. Because the control flaps 49, 51 are provided both to the right and to the left of the trigger guard 13, the unlocking of the magazine 11 can be operated in multiple ways and regardless of whether the marksman is right-handed or left-handed. The control surfaces 43, 45, 47 may be provided with grooves to improve handling. However, alternatively they can be furnished with knurls, pimples, dents and/or recessed grips or other surface structures that improve handling. As a further alternative, the control surfaces 43, 45, 47 may be designed with slip-resistant coatings or inserted elastomer elements. In an alternative design (not shown) the trigger guard 13 is interrupted, the resulting gap is filled in with the second operative control 31, which may be designed with or without control flaps 49, 51.

The lever 27 is fixed in the case region 15 via the pin 33 that penetrates the case 5. The pin 33 also simultaneously defines a swivel axis 33 of the lever 27. The fixation of the lever 27 may also occur via bearing journals (not shown) constructed on the lever 27 itself, which may be pivotable though axially fixed in a suitable manner in the case 5. The lever 27 can be manufactured of a relatively light plastic material such as, for example, in a single piece via an injection molding. The lever 27 may also include metal inserts that may absorb shocks, impacts and other forces that occur from use of the firearm 1 so that these forces will not release the magazine 11 from the weapon 1. The spring resistance of the leg spring acting on the lever 27, the lengths of the locking end 35 or of the operating end 25, the position of the swivel axis 33 and the arrangement of the first and second operative controls 29, 31 and their respect control surfaces 43, 45, 47 and flaps 49, 51 are configured relative to one another to ensure the securest conceivable locking of the magazine 11 in the magazine well 9 while simultaneously permitting the operation of the lever 27, without requiring operating forces E and F to become so great that an excessive exertion of the operating hands of the marksman is needed to release the magazine 11.

The case 5 of the illustrated example firearm 1 also has a breechblock stop 53 that holds a breechblock 55 open after the firing of the last cartridge from the magazine 11 (FIG. 2). The breechblock stop 53 has a tongue 57 pointing forward at the upper end of the breechblock stop 53. The tongue 57 is moved upward by a magazine follower 59, which is located in the magazine 11. When the magazine 11 is empty, the follower 59 is moved upward to the topmost position, which engages the tongue 57 and moves the tongue 57 to the topmost position as well thereby causing the breechblock stop 53 to engage the breechblock 55. The tongue 57 itself extends only so far into the magazine 11 that the tongue 57 is not touched by the rear ends of the cartridge cases (not shown), but only the rear end of the follower 59. The follower 59 runs in a guide groove 61 in the magazine 11, lifts the tongue 57 so that a catching surface 63 on the tongue 57, which points to the rear, extends into the path of motion R of the breechblock 55. The breechblock 55, which runs forward because the breechblock 55 is under the force of a spring load, moves only so far forward that a snap-in surface or forward-pointing adjoining face 65 of the breechblock 55 (i.e., the front of the breechblock 55) abuts the catching surface 63 of the tongue 57, which stops the motion of the breechblock 55. A part of the breechblock stop 53 protrudes downward out of the case 5 into the trigger region 3. As mentioned above, the slider 21 also extends into the trigger region 3 and runs along the front region of the trigger guard 13, which is formed by the case 5. The slider 21 has a control extension 67 on its lower end and a handle 69 on its upper end that protrudes from the case 5. The handle 69 only slightly extends into the trigger region 3.

The control extension 67 proceeds in the first recess 19 in the trigger guard 13 inwardly toward the trigger 23. The control extension 67 is surrounded by the enlargement 17, which may be beveled (compare FIGS. 1 and 3). The breechblock stop 53 is held via a leg spring 71, whose one leg 72 is held by a first groove 73 and whose other leg 74 is held at a suitable place in the trigger region 3.

The leg spring 71 biased to direct the breechblock stop 53 into the closed position (downward), i.e., so the breechblock 55 is closed. The force of the leg spring 71 may be overcome with a counter force such as the force created by moving the follower 59 upward, which would move the breechblock stop 53 upward. In addition, the force of the leg spring 71 is not sufficient to overcome the frictional force acting between the front 65 of the breechblock 55 and the catching surface 63 of the breechblock stop 53. Thus, the breechblock 55 still remains opened when the follower 59 is no longer applying the counter force by engaging the tongue 57 such as, for example, when the emptied magazine 11 is removed and is replaced by a filled ammunition magazine 11.

In a conventional weapon, the breechblock stop 53 would be released by slightly pulling back a firing lever (not shown) along with the breechblock 55. This would cause the catching surface 63 on the breechblock stop 53 and the corresponding adjoining face 65 of the breechblock 55 to separate. As the breechblock stop 53 and the breechblock 55 separate, the breechblock stop 53 snaps downward due to the spring load pulling the catching surface 63 out of the path of motion of the breechblock 55, which allows the breechblock 55 to move forward (for example in a position such as the position shown in FIG. 3) and guide a cartridge into the cartridge chamber.

In the present example, the control extension 67 eliminates the need for pulling back the firing lever. As shown in the examples, the breechblock stop 53 may now be unlocked by pressing the trigger finger down onto the control extension 67 to move the control extension 67 downward into the first recess 19. Because the control extension 67 is connected to the breechblock stop 53 via the handle 69, downward movement of the control extension 67 causes downward movement of the breechblock stop 53. Consequently, the catching surface 63 is pulled out of engagement with the face 65 of the breechblock 55. The breechblock 55 is now released and, as described above, moves forward.

With conventional firearms, after the marksman changes the magazine 11 with one hand, he uses that hand to cock the firing lever to release the breechblock 55, as described above. In the current example, the marksman can release the breechblock 55 with the hand holding the weapon 1. Thus, the hand that changed the magazine 11 can immediately hold onto the weapon 1 again. This not only accelerates the reloading of the firearm 1 after changing the magazine 11, it also accelerates the ability of the marksman to sight a target with the help of both hands. Thus, the marksman only has to replace the magazine 11 and release the breechblock stop 53 via the control extension 67 for the weapon 1 to be ready to fire again.

In addition, the state of the weapon can be felt through the control extension 67. Usually it is not clear to the marksman whether the firing sequence has ended due to the fact that the magazine 11 is empty or due to the fact that a jam has occurred. The position of the control extension 67 now makes it possible to distinguish without having to examine the weapon 1 more precisely. If the breechblock stop 53 is in the described operative position with an emptied magazine 11, then the control extension 67 protrudes from the first recess 19 in the trigger guard 13 (FIG. 2). Thus, the marksman can feel the control extension 67 in the interior of the trigger guard 13 projecting from the enlargement 17. If the breechblock stop 53 is in its resting position, the edge of the enlargement 17 in the trigger guard 13 runs flush with the surface of the control extension 67 pointing upward (FIG. 1). Thus, the marksman feels a smooth, continuous surface and knows that the interruption or the end of the firing sequence must have a different cause (possible jamming). In other words, the marksman knows to investigate the operation of the firearm 1 and/or take other measures to overcome a jam when the position of the control extension 67 of the breechblock stop 53 indicates that the magazine 11 has not been emptied.

The aforementioned handle 69 makes it possible, without holding a firing lever, to push the breechblock stop 53 upward even with the magazine 11 removed or without the action of the follower 59 to hold open the breechblock 55, which is useful, for example, for inspection of the weapon.

To allow the breechblock stop 53 and the lever 27 for locking the magazine 11 to work independently of one another, a second recess 75 matching the first recess 19 in the trigger guard 13 is provided between the two control flaps 49, 51. This second recess 75 can, as shown, be constructed as an opening in an intermediate region 77 connecting the two control flaps 49, 51. However, the second recess 75 can also result from the fact that the two control flaps 49, 51 are constructed as "fork tines" which, proceeding from the operating lever 27, each run along the trigger guard 13.

The second recess 75 prevents particulates or contaminants such as, for example, dirt from accumulating under the control extension 67 and from moving the lever 27 and releasing the magazine 11 while the breechblock stop 53 is being released. The second recess 75 also prevents material build-up from occurring between the underside of the trigger guard 13 and the intermediate region 77 so that no foreign materials actuate the control extension 67 from below and unintentionally move the breechblock stop 53 into an operative position where the breechblock stop 53 blocks the breechblock 55.

The combination of the lever 27 and the breechblock stop 53 described in these examples together with their operative controls 21, 29, 31 enable the marksman to easily complete all the steps needed for reloading the weapon 1. However, note that the lever 27 can be used for spring-loaded locking the removable ammunition magazine 11 with or without the spring-loaded breechblock stop 53.

The front leg 72 of the leg spring 71 loading the breechblock stop 53 can be extended forward over the breechblock stop 53 to disable the breechblock stopping function. The front leg 72 is located with its end just below a projection 76, which is constructed in the case 5 of the weapon 1. As illustrated in FIG. 3, the first groove 73 and a second groove 79 are constructed in the breechblock stop 53 for holding the leg spring 71. The distance from the grooves 73, 79 to a horizontal extension of a lower surface of the projection 76 in the case 5 is slight. The bottoms of the two grooves 73, 79 have a variable distance to the lower surface of the projection 76. When the leg spring 71 is located in the first groove 73, where there is a great distance to the horizontal extension, the function of the breechblock stop is unobstructed, as described above. When the leg spring 71 is located in the second, higher groove 79, the function of the breechblock stop 53 is suppressed because the extended end of the leg spring 71 only grips the projection 76 on the case 5, which blocks the upward movement of the leg spring 71 and, with it, the upward movement of the breechblock stop 53. The setting of the breechblock stop 53, i.e., positioning the leg spring 71 in lower groove 73 or upper groove 79, can be made at the factory or at any time on the weapon 1 with a suitable tool (e.g. a thin screwdriver or the tip of a knife).

One of ordinary skill in the art would recognize that the firearm 1 of the illustrated examples has several advantages including shortening the time needed to change the magazine 11, enabling the marksman to change the magazine 11 and reload the firearm 1 without compromising the marksman's cover or changing the position of his aim. Further, the firearm 1 of the illustrated examples is insensitive to incorrect operations, for example unintentional opening or closing of the breech.

These advantages are accomplished in part through the construction of a trigger device for a firearm 1, in particular a rifle 1 that includes the spring-loaded breechblock stop 53, which can be moved by engagement with the follower 59 of the ammunition magazine 11 from a resting position, in which the breechblock 55 is released, into an operative position, in which the breechblock stop 53 locks the breechblock 55 in open position. The breechblock stop 53 includes the slider 21 arranged on the trigger guard 13 that can be operated by a finger of the shooting hand that grasps the grip 7. The slider 21 is actuated to adjust the breechblock stop 53 from the operative position to the resting position so that the breechblock 55 is released. As described above, the breechblock stop 53 is constructed as a push-actuated device, i.e., the slider 21, which includes the control extension 67 in the trigger guard 13. The direction of operation of the slider 21 runs essentially perpendicular to the force releasing the trigger 23.

The slider 21 is particularly well accessible because the slider 21 runs in the trigger region 3, within the trigger guard 13 and opposite the trigger 23, to be precise. In some examples, the interior surface of the trigger guard 13 may also be formed by a portion of the case section 15. This arrangement creates a trigger safety and prevents unintended operation of the slider 21 because the trigger guard 13 practically forms a cage around the slider 21. The guiding of the slider 21 downward into the first recess 19 in the trigger guard 13 improves and stabilizes the trigger safety features and helps prevent damage of the slider 21 from, for example, breaking or bending. In addition, the inwardly extending control extension 67 facilitates operation of the slider 21 and, thus, the breechblock stop 53. Actuation of the control extension 67 may, for example, take place via the index finger of the shooting hand that rests on the trigger 23.

In some examples, the breechblock stop 53, the slider 21 and the control extension 67 can be manufactured of a single piece, for example as a metallic cast part, as a forged piece or also as a plastic injection molded part. If formed as a plastic injection molded part, the breechblock stop 53, the slider 21 and the control extension 67 may include one or more metal inserts.

As mentioned above, there are still further advantages to the examples described herein. For example the positioning of the slider 21 or the control extension 67 and, accordingly, the positioning of the breechblock stop 53 can be detected by touch. If the breechblock stop 53 is located in its operative position, the control extension 67 protrudes at least partially upward out of the trigger guard 13. If the breechblock stop 53 is locate in its resting position, the control extension 67 is flush with the profile of the trigger guard 13. These variable positions can be easily detected by the marksman by touch through his fingers. If the firearm 1 does not fire and the breechblock stop 53 is in its operative position (the control extension 67 is protruding), the magazine 11 is empty. If the firearm 1 does not fire and the breechblock stop 53 is in its resting position (the control extension 67 is not protruding), the magazine 11 is not empty, and a jam or some other malfunction of the firearm 1 may have occurred. Thus, if there is an unexpected or unintended interruption in the firing sequence, the marksman can easily determine with his finger if the magazine 11 is empty or if a malfunction has occurred.

Not only does the alignment and protrusion of the control extension 67 enable the marksman to determine the status of the magazine 11, i.e., whether or not it is empty, or if a malfunction has occurred, this construction enables the unlocking of the breechblock stop 53 without requiring the marksman to remove his finger from the trigger region 13. As mentioned above, the breechblock stop 53 is in its operative position, i.e., the breech 55 is locked, when the control extension 67 protrudes from the trigger guard 13, and the breechblock stop 53 is in its resting position, i.e., the breech 55 is open, when the control extension 67 does not protrudes from the trigger guard 13. Thus, to unlock the breech 55, the marksman applies a downward force, i.e., a force perpendicular to the force needed to actuate the trigger 23, on the control extension 67 of the slider 21, without removing his finger from the trigger region.

In the illustrated examples, the slider 21 of the breechblock stop 53 can be arranged flush with the second operative control 31 of the lever 27 for locking a magazine 11 but without interactively engaging one another. Thus, the second operative control 31 has the second recess 75 that is substantially aligned with the first recess 19 in the trigger guard 13. The two recesses 19, 75 prevent impurities, dirt or objects from being deposited or from accumulating and effecting either the operation of the breechblock stop 53 and/or the positioning of the magazine 11, i.e., the locking of the magazine 11 in the magazine well 9. Furthermore the lack of accumulation of foreign objects ensures that actuation of the slider 21 does not unintentionally or inadvertently cause actuation of the second operative control 31 and vice versa. That is, a release of the breechblock stop 53 does not cause the magazine 11 to be released, just as an operation of the second operative control 31 to unlock the magazine 11 or to insert a new magazine 11 has no effect on the position of the breechblock stop 53.

In some example, the grooves 73, 79 may be provided to disable the function of the breechblock stop 53. The operation of these groove 73, 79 are described in greater detail above. The grooves 73, 79 serve as a locking mechanism and fix the breechblock stop 53 in its resting position.

Other examples, as described above include the semi-automatic weapon 1 such as the rifle 1 that includes the spring-loaded lever 27 that is used to lock and unlock the removable ammunition magazine 11. The lever 27 includes the operating end 25 that includes at least two variably oriented operative controls 29, 31 via which an unlocking force E, F, respectively, can be exerted.

Further designs and functions of the breechblock stop 53 are described in German Patent Application DE 196 55 169, which is hereby incorporated herein by reference in its entirety. This application also claims priority to German Patent Application 103 53 155.6, which is also hereby incorporated herein by reference in its entirety, Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm comprising:

a trigger that requires a force to be released;

a trigger guard;

a breechblock;

a spring-loaded breechblock stop that is operable between a resting position and an operative position, wherein the breechblock stop includes a linearly slidably actuated slider control that has a control extension in the trigger guard;

a removable ammunition magazine that includes a follower;

wherein the breechblock stop may be moved between an operative position and a resting position by one of engagement with the follower of the magazine or actuation of the slider control in a direction of operation essentially perpendicular to the force releasing the trigger; and wherein the breechblock is unlocked in a released position when the breechblock stop is in the resting position, and the breechblock is locked in an open position when the breechblock stop is in the operative position.

2. A firearm as defined in claim 1, wherein the slider extends before the trigger at a surface adjoining a trigger region that contains the trigger.

3. A firearm as defined in claim 1, wherein the slider, the control extension and the breechblock stop are constructed in a single piece.

4. A firearm as defined in claim 1, wherein the control extension extends from above out of the trigger guard into a trigger region when in an operative position.

5. A firearm as defined in claim 1, wherein the control extension extends into the trigger guard when in a resting position.

6. A firearm as defined in claim 1, wherein the trigger guard further includes an enlargement surrounding a first recess, wherein the enlargement at least partially encloses the control extension.

7. A firearm as defined in claim 1, further comprising a lever, wherein the lever includes a first operative control for locking the magazine that extends in a front region of the trigger guard and has a second recess matching a first recess of the trigger guard.

8. A firearm as defined in claim 7, wherein the first operative control has a first control flap to the left of the trigger guard and a second control flap to the right of the trigger guard.

9. A firearm as defined in claim 7, wherein the lever is a spring-loaded lever further comprising a second operative control, wherein the first operative control and the second operative control are variably oriented to receive differently directed unlocking forces to unlock the magazine.

10. A firearm as defined in claim 1, further comprising a locking mechanism, wherein the locking mechanism may disable the breechblock stop.

11. A breechblock stop for use in a firearm having a trigger that requires a force to be released and is located in a trigger guard, the breechblock stop comprising:

a tongue;

a slider including a control extension;

wherein the control extension is at least partially in the trigger guard;

wherein the breechblock stop may be moved between an operative position and a resting position by linear actuation of the slider via the control extension in a direction of operation essentially perpendicular to the force releasing the trigger; and wherein the breechblock stop is spring-loaded.

12. A method of unlocking a breechblock stop in a firearm, the method comprising linearly slidably actuating a control extension of a slider with a finger used to operate a trigger of the firearm to move the control extension down into a recess in a trigger guard, which pulls the breechblock stop downward, wherein downward movement of the breechblock stop causes a catching surface of the breechblock stop to be pulled out of engagement with a face of a breechblock, which releases the breechblock.

13. A method of unlocking a breechblock stop in a firearm as defined in claim 12, wherein the direction of operation of the slider runs essentially perpendicular to a force to release the trigger.

* * * * *